US008281632B2

(12) United States Patent
Uijtdebroeks et al.

(10) Patent No.: US 8,281,632 B2
(45) Date of Patent: Oct. 9, 2012

(54) DEVICE AND METHOD FOR COOLING ROLLERS USED FOR ROLLING IN A HIGHLY TURBULENT ENVIRONMENT

(75) Inventors: Hugo Uijtdebroeks, Hasselt (BE); Patrick Van Poecke, Zaffelare (BE); Dirk Vanderschueren, Rossdaal (BE); Jean-Francois Noville, Milmort (BE)

(73) Assignee: Centre de Recherches Metallurgiques asbl, Brussels (BE)

( * ) Notice: Subject to any disclaimer, the term of this patent is extended or adjusted under 35 U.S.C. 154(b) by 442 days.

(21) Appl. No.: 12/525,743

(22) PCT Filed: Dec. 21, 2007

(86) PCT No.: PCT/BE2007/000129

§ 371 (c)(1),
(2), (4) Date: Aug. 4, 2009

(87) PCT Pub. No.: WO2008/104037

PCT Pub. Date: Sep. 4, 2008

(65) Prior Publication Data

US 2010/0089112 A1 Apr. 15, 2010

(30) Foreign Application Priority Data

Feb. 9, 2007 (BE) ..... 2007/0055

(51) Int. Cl.
*B21B 1/00* (2006.01)

(52) U.S. Cl. ..... 72/201

(58) Field of Classification Search ..... 72/201, 72/236, 342.3, 227

See application file for complete search history.

(56) References Cited

U.S. PATENT DOCUMENTS 1,392,757 A * 10/1921 Gales ..... 180/68.5

(Continued)

FOREIGN PATENT DOCUMENTS

DE 20314591 U1 11/2003

(Continued)

OTHER PUBLICATIONS

Ye et al.; The Role of Spray Cooling on Thermal Behavior and Crown Development in Hot-Strip Mill Work Rolls; publication I&SM, Jul. 1994, 12 pages, pp. 49-60.

(Continued)

*Primary Examiner* — Dana Ross
*Assistant Examiner* — Homer Boyer
(74) *Attorney, Agent, or Firm* — Reinhart Boerner Van Deuren P.C.

(57) ABSTRACT

(EN) The present invention relates to a device for cooling a working roll (1, 2) belonging to a rolling stand used for rolling a long or flat product (3), characterized in that it comprises a cooling head in the form of a box section (6A, 6B) that is sealed except along a front face (42) lying a short distance from said roll (1, 2), and in which face a plurality of nozzles (41) has been machined or positioned in a determined pattern, said box section (6A, 6B) being concave and cylindrical at its front face (42). The box section (6A, 6B) is also fitted with transverse (5, 7) and lateral (8) plates which collaborate with the front face (42) of the box section so as to control the flow of cooling liquid and confine said liquid in the form of a highly turbulent flow. This then yields optimal cooling of the roll both in terms of the uniformity of the cooling across the surface thereof and in terms of the reduction in temperature as a result of the turbulent effect created.

19 Claims, 6 Drawing Sheets

U.S. PATENT DOCUMENTS

| | | | | | |
|---|---|---|---|---|---|
| 3,192,757 | A | * | 7/1965 | Diolot | 72/201 |
| 4,422,318 | A | * | 12/1983 | Christ et al. | 72/200 |
| 4,671,091 | A | * | 6/1987 | Atack et al. | 72/45 |
| 5,046,347 | A | * | 9/1991 | Crosato et al. | 72/201 |
| 5,212,975 | A | * | 5/1993 | Ginzburg | 72/43 |
| 5,553,469 | A | * | 9/1996 | Seidel | 72/13.4 |
| 5,694,799 | A | * | 12/1997 | Wolpert et al. | 72/43 |
| 6,152,210 | A | * | 11/2000 | Baharis et al. | 164/502 |
| 6,499,328 | B2 | * | 12/2002 | Faggiani et al. | 72/201 |
| 6,772,961 | B2 | * | 8/2004 | Forbes et al. | 239/79 |
| 7,159,433 | B2 | * | 1/2007 | Seidel | 72/201 |
| 7,266,984 | B2 | * | 9/2007 | Cerv et al. | 72/236 |
| 7,523,631 | B2 | * | 4/2009 | Fujibayashi et al. | 72/201 |

FOREIGN PATENT DOCUMENTS

| | | | |
|---|---|---|---|
| EP | 0 599 277 | | 6/1994 |
| EP | 0 919 297 | | 6/1999 |
| EP | 1516683 | A1 | 3/2005 |
| GB | 2 207 373 | A | 2/1989 |
| JP | 58-47502 | A | 3/1983 |
| JP | 61-176411 | A | 8/1986 |
| JP | 61-266110 | A | 11/1986 |
| JP | 63-303609 | A | 12/1988 |
| JP | 1-224105 | A | 9/1989 |
| JP | 2-84205 | A | 3/1990 |
| JP | 3-142009 | A | 6/1991 |
| JP | 5-104114 | A | 4/1993 |
| JP | 6-339712 | A | 12/1994 |
| JP | 7-116714 | A | 5/1995 |
| JP | 10-291011 | A | 11/1998 |
| JP | 11-33610 | A | 2/1999 |
| JP | 11/277113 | A | 10/1999 |
| JP | 2001-1017 | A | 1/2001 |
| JP | 2001-340908 | A | 12/2001 |

OTHER PUBLICATIONS

Sekimoto et al.; Effects of Rolling Condition on the surface temperature of Work Roll in Hot Strip Mill; publication SEAISI Quarterly, Apr. 1977, 10 pages, pp. 48-57.

Van Steden et al.; A New Method of Designing a Work Roll Cooling System for Improved Productivity and Strip Quality; paper from 4th International Steel Rolling Conference, Deauville, France, Jun. 1-3, 1987, 13 pages, pp. A29.1-A29.12.

* cited by examiner

Center: Low HTRC 2.4 bar ‹› Low conventional 8 bar

Surface of the top roller
(coventional cooling)

Surface of the bottom roller
(cooling HTRC)

DEVICE AND METHOD FOR COOLING ROLLERS USED FOR ROLLING IN A HIGHLY TURBULENT ENVIRONMENT

CROSS-REFERENCE TO RELATED PATENT APPLICATIONS

This patent application is the National Stage of International Application No. PCT/BE2007/000129, filed Dec. 21, 2007, that claims the benefit of Belgium Application No. 2007/0055, filed Feb. 9, 2007, the entire teachings and disclosure of which are incorporated herein by reference thereto.

FIELD OF THE INVENTION

The present invention relates to a new method for cooling rolling cylinders (or rolls), possibly of variable diameter, based on a highly turbulent flow environment (high turbulence cooling, HTC). The method is called high turbulence work roll cooling (HTRC).

The invention also relates to the device for implementing the method.

TECHNOLOGICAL BACKGROUND AND STATE OF THE ART

The heating of hot-rolling cylinders is due to the transmission of heat to the rolls by conduction from the product, such as a strip of metal, that is being rolled. In recent years, the cooling of rolling cylinders has been intensively studied because of its very large impact on the deterioration of said cylinders (wear) as a result of the thermomechanical fatigue generated and on the control of the curve of the cylinders. The deterioration of the cylinders has a very great impact on the quality of the product.

A typical installation for cooling work cylinders in a rolling stand is for example described in documents JP-A-2001 340908, JP-A-2001 001017, JP-A-07 116714, JP-A-05 104114, JP-A-63 39712, JP-A-61 176411 etc. Cooling-water tubes, modules or tanks are equipped with atomisers and positioned around each cylinder, with a means for supplying cooling water. Guide plates for the cooling water are positioned in association to the upper cylinder and to the lower cylinder. These plates are equipped with a scraper, for example covered with rubber, associated to each of the cylinders in order to prevent the water from flowing over the product that is being rolled.

A major problem to be solved in the case of the cooling of work cylinders is that of obtaining homogeneous cooling across the width and around the circumference. Solutions exist in which the flows supplied by the various nozzles of a cooling module are individually regulated on the basis of data provided by a sensor, such as an infrared thermometer (for example JP-A-12 24105). Another solution consists in using heads with water-spraying holes distributed according to an appropriate pattern, in the axial dimension and in the dimension of the circumference (JP-A-10 291011). A third solution is to use a motorised head with nozzles on side guides (EP-A-0 599 277).

Recent authors recognise for one thing that the impact of the nozzles positioned as close as possible to the rollgap turns out more effective and for another that intensive cooling by flat nozzles has a reduced impact on the temperature of the roll than the surface covered (YE, X. and SAMAVASEKARA, I. V., *The Role of Spray Cooling on Thermal Behaviour and Crown Development in Hot Strip Mill Work Rolls*, Transactions of the ISS, July 1994, p. 49).

One possible consequence of the application of cooling of the roll close to the point of exit from the roll is an increase in the tension gradient on the surface of the roll and a worsening of the cracking ("fire crazing"), but with a lower temperature below the surface of the roll (SEKIMOTO et al, SEAISI Quarterly, April 1977, p. 48).

It is known that the type of spray (or nozzle) used for cooling rolls has a significant effect on the HTC values. VAN STEDEN and TELLMAN in *A new method of designing a work roll cooling system for improved productivity and strip quality*, Fourth International Hot Rolling Conference, Deauville, France, 1987, compared the performance of nozzles with flat, square and oval jets by measuring the thermal response of a plate attached to a cylinder after heating to 400° C., followed by cooling by water atomisation when the cylinder is rotated. Values of up to 140 $kW/m^2.K$ were obtained for the range of nozzles considered. This work showed that the highest HTC value relative to the atomising peak is achieved by the nozzle with the flat type of jet. However, this study obviously ignores the fact that the same cooling performances may be obtained by a nozzle with a lower peak HTC value but whose jet is applied over a much greater part of the surface of the roll. One therefore notes significant differences in the literature concerning both the HTC value associated with the nozzle and the suitability of various types of nozzles for the effective cooling of rolls.

It is certain that, in the rolling of flat strips, cooling systems based on nozzles with flat jets can be further improved. However, these improvements are limited and the costs are very high since one is working at high pressures and high flow speeds.

In recent years, various alternative cooling technologies have been patented based on heads positioned close to the surface of the work cylinder and with a flow circulation (for example EP-A-919297, JP-A-11 033610). However, no industrial applications of these cooling systems are known. Roll-cooling devices are thus also known in which a cooling head is shaped to ensure that the water is guided over the surface of the roll. The surface of the head is separated from that of the roll by a gap in which the cooling water circulates, creating a sort of "sleeve" (JP-A-61 266110, JP-A-63 303609, JP-A-20 84205). The water may either be fed through one end of the head and drained at the other end (JP-A-20 84205) or be fed through both ends and drained at the centre (EP-A-919 297), the draining occurring through the head itself, with scraper systems preventing leakage around the circumference of the rolls. Draining to the outside may also occur between one end of the head and the surface of the roll (JP-A-11 277113). Document JP-A-58 047502 describes moreover a cooling shoe that is deformable by means of springs so as to adapt to the surface of the roll.

In these systems, there are no water-supply atomisers distributed over the whole surface of the cooling head but instead, there is generally one single atomiser.

The Applicant began to examine alternative cooling technologies in 1993. Trials were conducted with a cooling head in a high turbulence, low-pressure (HTLP) environment and with a water pillow cooling (WPC) head positioned beyond the scraper. Both technologies allow to create strong turbulence on the surface of the roll. In this way, a very homogeneous cooling pattern is obtained. Preliminary simulations of highly turbulent cooling have shown the potential of this technology for cooling work cylinders. Highly turbulent cooling reduces thermal fatigue and hence deterioration of the surface of the work cylinder. Moreover, for the same flow of heat dissipated during cooling, this technology requires lower flow speed and pressure compared with traditional configurations for cooling by vaporisation with a flat jet.

AIMS OF THE INVENTION

The present invention aims to provide a solution that allows to overcome the drawbacks of the state of the art.

In particular, this invention aims to provide effective cooling of rolling cylinders whilst guaranteeing a reduction of thermo-mechanical fatigue and hence less deterioration in the surfaces of the cylinders.

The invention also aims to require lower flow speed and water pressure at equivalent thermal exchange than the cooling systems of the state of the art, in particular those with a flat jet.

The present invention further aims to design a cooling device capable of being easily adapted to cylinders of variable diameter.

MAIN CHARACTERISTIC ELEMENTS OF THE INVENTION

A first aspect of the present invention relates to a cooling device for a work cylinder in a rolling stand for a long or flat product, characterised in that it comprises a cooling head in the form of a box that is more or less watertight in itself except on its front, positioned at a short distance from said cylinder and in which several nozzles have been machined or positioned according to a two-dimensional pattern, said box, equipped with a means for supplying a liquid coolant, being concave and cylindrical at the level of its front with a radius such that, when the device is in the working position, the distance in the radial direction between said front and the surface of the cylinder increases starting from the end of the box closest to the rollgap and going away from the product being rolled.

According to the invention, the cooling head is equipped with a transverse lower plate positioned lengthwise relative to the cylinder and located at a distance from the cylinder such that said lower plate co-operates with the front of the box in order to ensure the control of the flow of liquid coolant and its confinement in the form of a highly turbulent water pillow. The presence of this transverse lower plate is mandatory in the case of cylinders of small diameter.

As an advantage, the cooling head is also equipped with adjustable side plates positioned at the side of the transverse ends of the cylinder and located at a distance from the cylinder in such a way that said side plates co-operate with the front of the box and with the transverse lower plate in order to ensure the control of the flow of liquid coolant and its confinement in the form of a highly turbulent water pillow.

As an advantage, the curve of the side plates matches the maximum curve of the cylinders used in the installation.

According to a preferred embodiment, the front comprises a plate or sheet in which are positioned or machined the nozzles whose apertures are made of little holes of straight axial cross-section.

As a further preference, the apertures of the nozzles are of round, square or oval transverse cross-section.

The radius of the cylindrical concave surface of the front advantageously has a value higher than the predetermined maximum value of a cylinder radius, which restricts the range of size of usable cylinders.

Still according to the invention, the pattern for machining the nozzles is selected so as to make the cooling of the cylinder as homogeneous as possible across the whole surface of the cylinder and in particular across the width of the cylinder.

As an advantage, the pattern for machining the nozzles is defined by the number, position and diameter or size of the apertures in the plate of said front.

According to another preferred embodiment, the apertures are machined according to a predetermined matrix and the above-mentioned pattern is obtained by blocking some apertures.

As an advantage, the liquid coolant comprises water.

Another aspect of the present invention relates to a method for cooling a work cylinder in a rolling stand for a long or flat product, in particular a metal strip, implementing the above-mentioned device, wherein:

- the cooling head is positioned close to the surface of the cylinder in order to create a gap of between 5 and 200 mm between the front of the box and said surface of the cylinder, said gap increasing starting from the rollgap and going away from the product being rolled;
- the cooling head is supplied with liquid coolant, preferably water, and this water is sprayed into said gap through nozzles having apertures with a diameter of between 1 and 6 mm;
- the pressure of the liquid coolant is adjusted to a value of between 1 and 6 bar and the specific flow rate between 100 and 500 $m^3$/hour/$m^2$, in order to create in the above-mentioned gap a liquid pillow in a highly turbulent state.

The pressure of the liquid coolant in the box is preferably below 4 bar.

As a further preference, the pressure of the liquid coolant is between 2 and 4 bar.

Still according to the method of the invention, the distance between the transverse lower plate and the cylinder is adjusted so as to create in the gap a specific flow rate of liquid of between 2 and 10 m/s, and preferably greater than 3 m/s.

The side plates are preferably adjusted so as to have a minimum aperture of between 0 and 10 mm.

DESCRIPTION OF AN EMBODIMENT AS IN THE STATE OF THE ART

Figure 1:
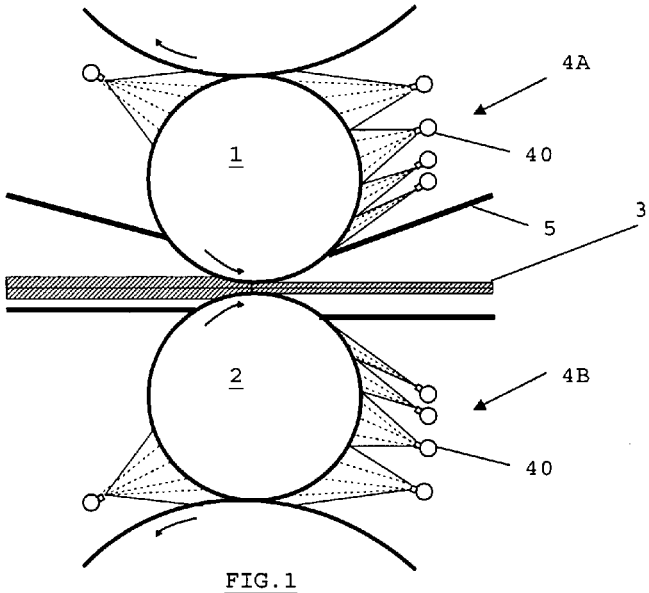
FIG.1 Prior Art
FIGS. 1A and 1B schematically show two embodiments showing the principle of the cooling head of a work cylinder on a hot-rolling line according to the state of the art (flat nozzles).

FIGS. 1A and 1B schematically show a cooling installation for a work roll in a rolling mill as in the state of the art with, in this example, either nozzles fitted onto independent tubes (FIG. 1A) or nozzles fitted onto a module (FIG. 1B). The pair of rolls comprises an upper roll 1 and a lower roll 2 rotating in opposite directions so as to move the steel strip 3. At the level of the upper roll, there is a cooling device 4A, with its control accessories, equipped with flat nozzles 40 facing the upper roll 1. At the level of the lower roll, there is a cooling device 4B, with its control accessories, equipped with flat nozzles 40 facing the lower roll 2.

In the device of FIG. 1A, the nozzles are placed on four tubes whereas in the device of FIG. 1B, the nozzles are fitted to a module 4A, 4B.

In general, the distance between the nozzles and the cylinder is 150-500 mm, which does not allow to use cylinders of different diameters with one single cooling device.

Description of Several Preferred Embodiments of the Invention

According to the invention, shown in FIGS. 2A to 2D, the cooling head is designed to implement WPC technology, i.e. with a view to create a pillow of highly turbulent water between the cooling head and the surface of the work roll. The turbulence is caused by spraying water at low pressure into the water pillow through nozzles with straight jets developed by the Applicant.

According to FIGS. 2A to 2D, the cooling installation as in the invention comprises an upper box 6A facing the upper roll 1 and a lower box 6B facing the lower roll 2. Each box 6A, 6B has a concave surface 42 opposite the corresponding roll 1,2. This concave surface 42 comprises a wall with several apertures of a specified size forming straight nozzles 41 and forming a specified pattern. The concave surface 42 may advantageously cover a larger part of the circumference in the case of the upper cylinder 1 than in the case of the lower cylinder 2.

Figure 2:
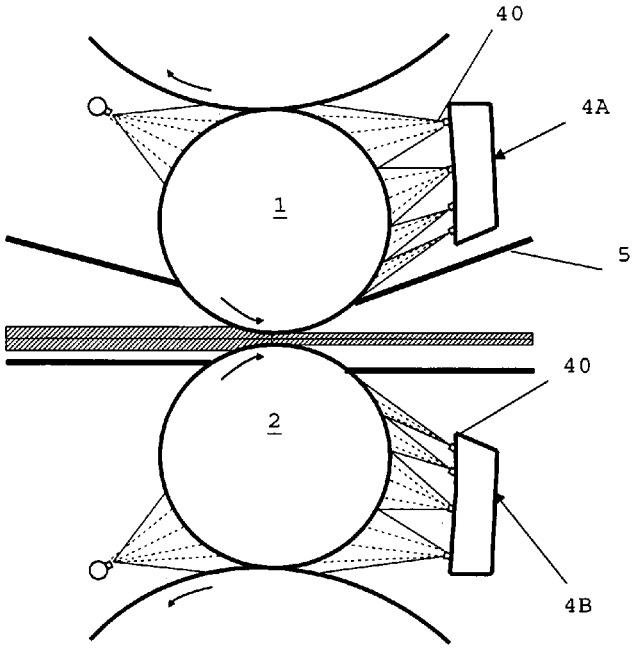
FIG.2 Prior Art
FIGS. 2A to 2D schematically show several embodiments showing the principle of such a cooling head in the case of the present invention (highly turbulent cooling).
Figure 2A:
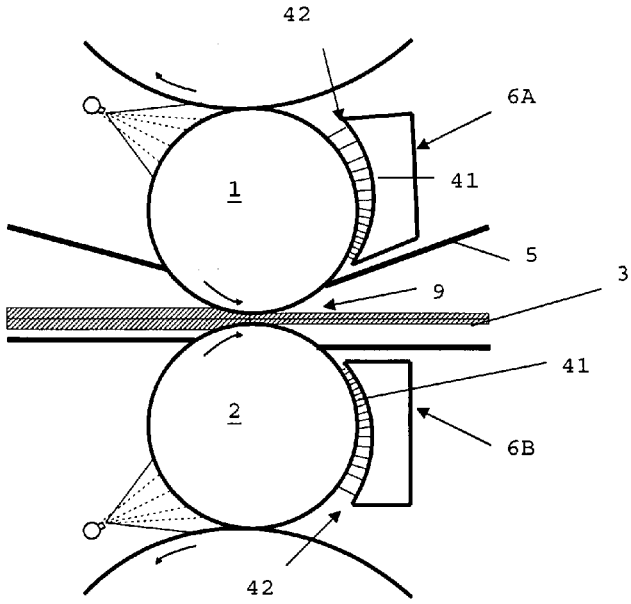
Figure 2B:
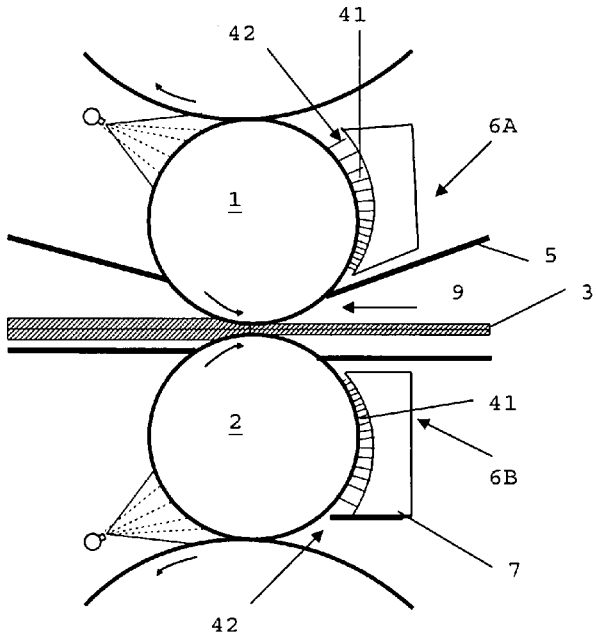
Figure 2C:
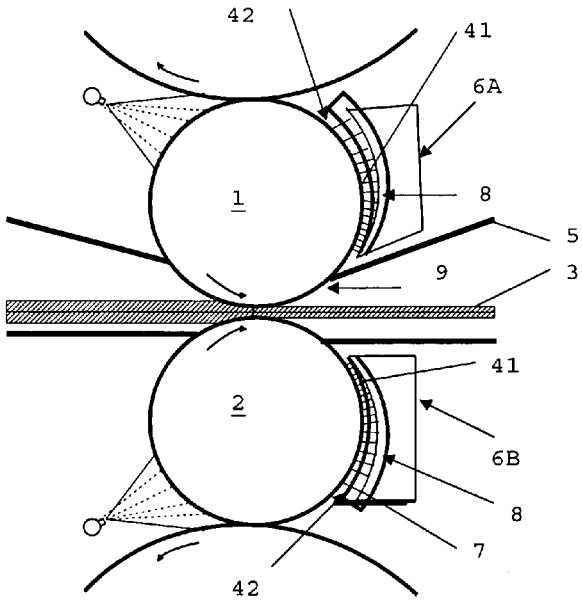
Figure 2D:
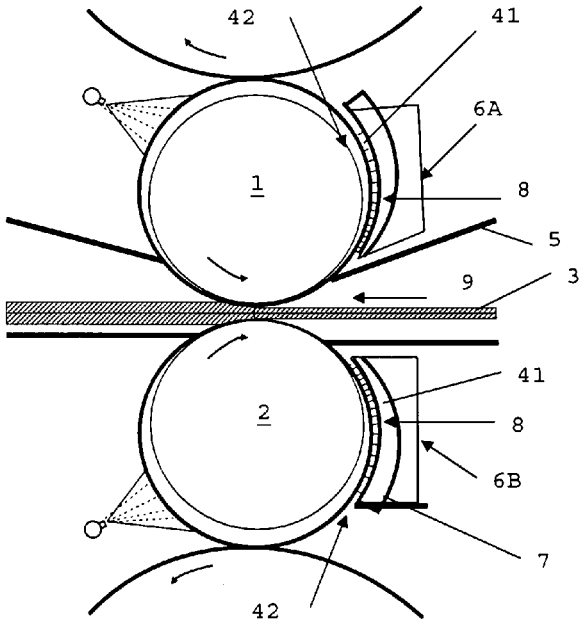

The water pillow is formed in the gap restricted by the roll and the cooling head but also, where relevant, by a transverse lower guide 7 (FIG. 2B) and/or by transverse guides 5, 7 and side guides 8 (FIGS. 2C and 2D). The side guides 8 may possibly be adjustably fitted depending on the diameter of the roll. The properties of the water pillow also depend on the flow rate of the water. The heated water flows to the outside by gravity or under the effect of pressure at the level of the gaps between the cylinders and the guides, without any additional draining device.

The shape of the cooling head as well as the distribution pattern of the nozzles with straight jets are specific to the present development, in particular with regard to taking into account variations in diameter, automatic changes of work rolls, for checking the roll profiles, the maintenance requirements and the offset and curve of the work rolls.

According to the invention, the shape of the cooling head has been machined to provide intensive cooling close to the rollgap. The distance between the surface of the head and the surface of the work roll thus decreases in the direction of the end of the head closest to the rollgap 9, where this distance is the smallest. In order to take into account variations in diameter, the radius of the concave part of the cooling head must be greater than the maximum possible radius of the work roll. Moreover, as already mentioned, adjustable transverse plates 5, 7 and side plates 8 have been provided in order to control the water flow but also to ensure the formation and stabilisation of the water pillow (FIGS. 2C and 2D).

The distribution pattern of the nozzles with straight jets has been chosen to obtain the optimum homogeneousness of the turbulence in the water pillow and also to control the thermal change and curve of the cylinder, taking into account the differential distribution of water across the entire width of the work roll.

Figure 3:
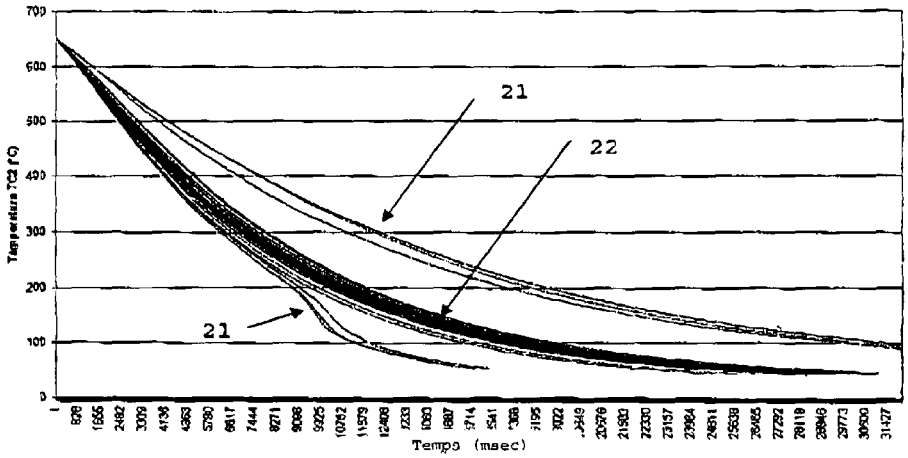
FIG. 3 graphically shows the change in temperature over time at different positions of the work cylinder in a conventional installation at 8 bar pressure and in the case of an HTRC installation as in the present invention, at 2.4 bar pressure and with water-guide plates, respectively.

FIG. 3 shows a comparison of the fall in temperature over time of the Cryotron probe used to determine the transfer coefficient, between a conventional cooling installation 21 (in grey) with flat nozzles working under water pressure of 8 bar and an installation 22 (in black) as in the invention with plates as described, working under 2.4 bar pressure (only at the level of the lower cylinder). Various curves have been plotted on a graph, in each case corresponding to different points of measurement over the circumference of the cylinder. FIG. 3 shows that there is much more homogeneous cooling in the case of the device of the invention.

Figure 4:
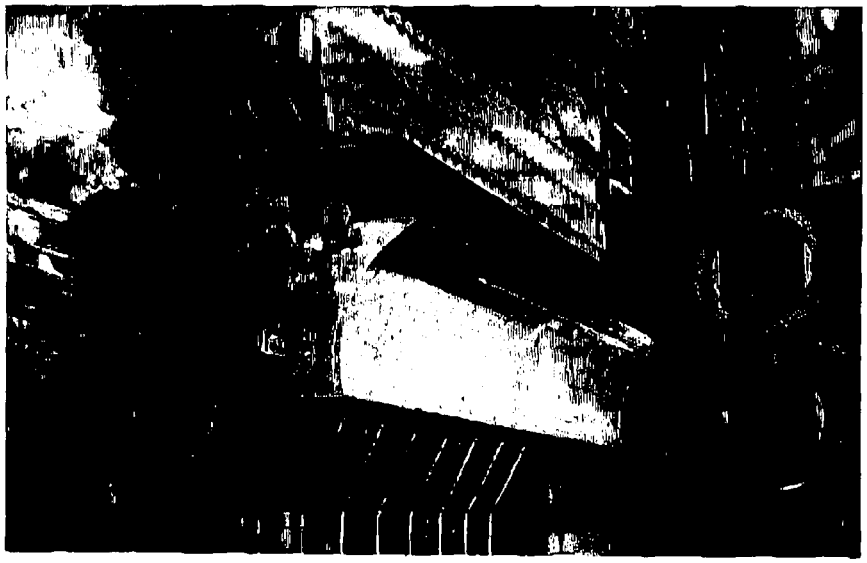
FIG. 4 shows the industrial installation of an HTRC cooling head.

An industrial trial was successfully carried out at a hot-rolling mill with a prototype HTRC head (see FIG. 4, HTRC module on lower cylinder and conventional cooling module on upper cylinder). The main advantages of the new system are low energy consumption, homogeneous distribution of the cooling water, greater cooling performance and reduced dispersion in the temperature measured on the cylinder surface.

Figure 5:
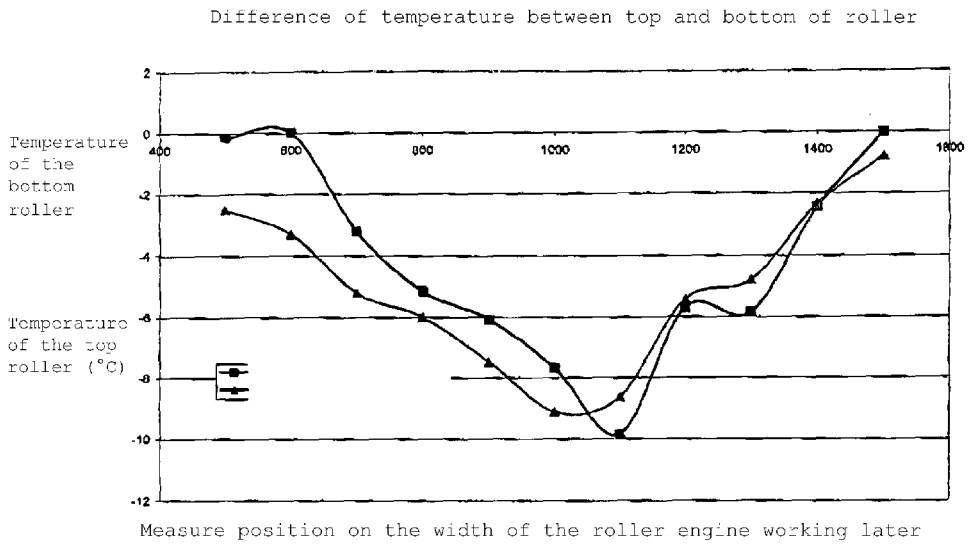
FIG. 5 graphically shows the cooling performance of the installation as in the invention at low pressure (only at the level of the lower cylinder) compared with cooling with a flat jet at high pressure as in the state of the art.

FIG. 5 shows the temperature differential between the lower and upper cylinders depending on the measurement position across the width of the roll, counting from the motor side (squares: HTRC on lower cylinder; triangles: state of the art). The performances are very similar. If HTRC cooling is carried out on the upper cylinder and on the lower cylinder at the same time, the cylinder temperature is lower by at least 7° C. relative to the performance obtained with the systems of the state of the art (not shown).

Compared with cooling systems of the state of the art, a lower water-flow pressure, advantageously of between 2 and 4 bar, is sufficient. This allows substantial savings over a period of a year, for example.

Figure 6:
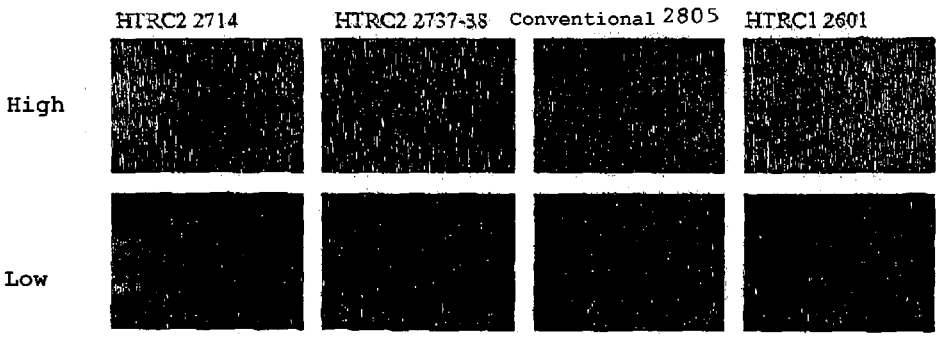
FIG. 6 shows the deterioration of the surfaces of the upper and lower cylinders in the case of three HTRC configurations and a configuration as in the state of the art, respectively.
Figure 7:
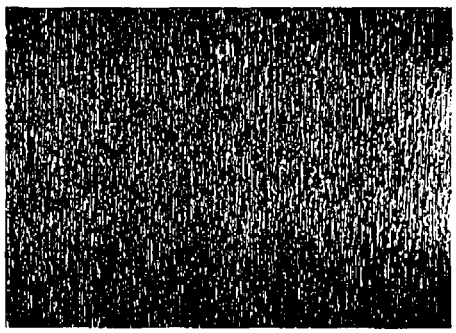
FIG. 7 shows the state of the surface of a cylinder after a rolling run using cooling as in the state of the art (on the left) and HTRC cooling as in the present invention (on the right), respectively.
Figure 7:
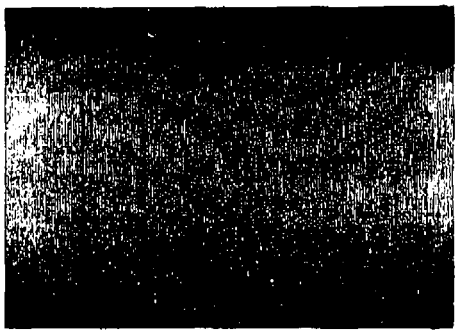

Since the first trials, a trend towards reduced wear of the work rolls has been noted with the use of the installation as in the present invention. FIG. 6 shows the effect of cooling on the deterioration of the surface of the work rolls (installation of FIG. 4). The four upper views correspond to cooling of the upper roll with flat nozzles as in the state of the art. The lower views nos. 1, 2 and 4 correspond to cooling of the lower roll as in the present invention; view no. 3 corresponds to cooling of the lower roll as in the state of the art. FIG. 7 shows in detail the state of the surface of the upper roll (traditional cooling, left) and of the lower roll (HTRC cooling, right), respectively, after a typical rolling run.

A new project has recently been started to determine the suitability of HTC cooling in the case of rolling long products.

The invention claimed is:

1. Rolling stand for rolling a long or flat product comprising a work cylinder (1,2) and a device for cooling said work cylinder (1,2), characterised in that it comprises a cooling head in the form of a box that is more or less watertight in itself (6A,6B) except on its front (42), positioned a short distance from said cylinder (1,2) and in which several nozzles (41) have been machined or positioned according to a two-dimensional pattern, said box (6A,6B), equipped with a means for supplying a liquid coolant, being concave and cylindrical at a level of its front (42) with a radius such that, when the device is in the working position, a distance in the radial direction between said front (42) and the surface of the cylinder (1,2) increases starting from the end of the box (6A,6B) closest to the rollgap (9) and going away from the product being rolled.

2. Rolling stand as in claim 1, wherein the cooling head (6A,6B) is equipped with a transverse lower plate (5,7) positioned lengthwise relative to the cylinder (1,2) and located at a distance from the cylinder (1,2) such that said lower plate (5,7) co-operates with the front (42) of the box in order to ensure the control of the flow of liquid coolant and its confinement in the form of a highly turbulent water pillow.

3. Rolling stand as in claim 2, wherein the cooling head (6A,6B) is moreover equipped with adjustable side plates (8) positioned at the side of the transverse ends of the cylinder (1,2) and located at a distance from the cylinder (1,2) such that said side plates (8) co-operate with the front (42) of the box and with the transverse lower plate (5,7) in order to ensure the control of the flow of liquid coolant and its confinement in the form of a highly turbulent water pillow.

4. Rolling stand as in claim 3, wherein the curve of the side plates (8) matches the maximum curve of the cylinders (1,2) used in the installation.

5. Rolling stand as in claim 1, wherein the front (42) comprises a plate or sheet in which are positioned or machined the nozzles (41) whose apertures are made of little holes of straight axial cross-section.

6. Rolling stand as in claim 5, wherein the apertures of the nozzles (41) are of round, square or oval transverse cross-section.

7. Rolling stand as in claim 1, wherein the radius of the cylindrical concave surface of the front (42) has a value higher than the predetermined maximum value of the radius of the cylinder (1,2), which restricts the range of size of usable cylinders.

8. Rolling stand as in claim 1, wherein the machining pattern of the nozzles (41) is selected so as to make the cooling of the cylinder as homogeneous as possible across the whole surface of the cylinder (1,2) and in particular across the width of the cylinder.

9. Rolling stand as in claim 5, wherein the machining pattern of the nozzles (41) is defined by the number, position and diameter or size of the apertures in the plate of said front (42).

10. Rolling stand as in claim 9, wherein the apertures are machined according to a specified matrix and wherein the above-mentioned pattern is obtained by blocking some apertures.

11. Rolling stand as in claim 1, wherein the liquid coolant comprises water.

12. Method for cooling a work cylinder in a rolling stand for a long or flat product, in particular a metal strip (3), implementing the device of claim 1, wherein:

the cooling head is positioned close to the surface of the cylinder in order to create a gap of between 5 and 200 mm between the front (42) of the box (6A,6B) and said surface of the cylinder (1,2), said gap increasing starting from the rollgap (9) and going away from the product being rolled;

the cooling head is supplied with liquid coolant, preferably water, and this water is sprayed into said gap through nozzles (41) having apertures with a diameter of between 1 and 6 mm;

the pressure of the liquid coolant is adjusted to a value of between 1 and 6 bar and the specific flow rate between 100 and 500 $m^3$/hour/$m^2$, in order to create in the above-mentioned gap a liquid pillow in a highly turbulent state.

13. Method as in claim 12, wherein the pressure of liquid coolant in the box (6A,6B) is below 4 bar.

14. Method as in claim 13, wherein the pressure of liquid coolant is between 2 and 4 bar.

15. Method as in claim 12, wherein the distance between the transverse lower plate (5,7) and the cylinder (1,2) is adjusted so as to obtain in the gap a specific flow rate of liquid of between 2 and 10 m/s, and preferably greater than 3 m/s.

16. Method as in claim 12, wherein the side plates are adjusted so as to have a minimum aperture of between 0 and 10 mm.

17. Rolling stand as in claim 1, wherein the box of the device maintains a fixed position relative to the cylinder.

18. Rolling stand as in claim 1, wherein the nozzles emit straight jets of the liquid coolant.

19. Method of claim 12, further comprising the step of fixing the position of the cooling head relative to the cylinder.

* * * * *